United States Patent [19]

Ehlig-Economides

[11] Patent Number: 4,803,873

[45] Date of Patent: Feb. 14, 1989

[54] PROCESS FOR MEASURING FLOW AND DETERMINING THE PARAMETERS OF MULTILAYER HYDROCARBON PRODUCING FORMATIONS

[75] Inventor: Christine Ehlig-Economides, Houston, Tex.

[73] Assignee: Schlumberger Technology Corporation, Houston, Tex.

[21] Appl. No.: 127,584

[22] Filed: Dec. 2, 1987

Related U.S. Application Data

[63] Continuation of Ser. No. 889,438, Jul. 23, 1987, abandoned.

[30] Foreign Application Priority Data

Jul. 23, 1985 [FR] France ..... 85 11260
Jul. 23, 1985 [FR] France ..... 85 11261

[51] Int. Cl.[4] ..... E21B 47/10
[52] U.S. Cl. ..... 73/155
[58] Field of Search ..... 73/155, 151, 38; 166/250; 364/422

[56] References Cited

U.S. PATENT DOCUMENTS

| | | | |
|---|---|---|---|
| 3,454,085 | 7/1969 | Bostock | 73/155 |
| 3,636,762 | 1/1972 | Kuo et al. | 73/155 |
| 3,871,218 | 3/1975 | Louis | 73/155 |
| 3,905,226 | 9/1975 | Nicolas | 73/155 |
| 3,954,006 | 5/1976 | Anderson et al. | 73/155 |
| 4,328,705 | 5/1982 | Gringarten | 73/155 |
| 4,423,625 | 1/1984 | Bostic, III et al. | 73/155 |
| 4,442,710 | 4/1984 | Meng | 73/151 |
| 4,495,805 | 1/1985 | Dowling et al. | 73/155 |
| 4,597,290 | 7/1986 | Bourdet et al. | 73/155 |

*Primary Examiner*—Jerry W. Myracle
*Attorney, Agent, or Firm*—Henry N. Garrana; John H. Bouchard

[57] ABSTRACT

The invention concerns a process for measuring the flow as a function of time of the several layers of a subterranean multilayer hydrocarbon-producing formation through which a well is drilled, and for determining the parameters of formation by comparison of trends in well behavior shown by actual measurements with trends in behavior established theoretically. The flow rate contributions of individual layers (1 to 5) are determined from cumulative measurements made above successive layers by a flowmeter (13) moved vertically within a wellbore. Experimental curves are derived that represent the relative variations in time of the flowrates of layers ($\Delta q_j$) or groups of layers in the formation using flowrate measurement points obtained when a total flowrate variation ($\Delta Q$) has been imposed on the well at a given time between two given constant values. These experimental curves are then compared to theoretical model curves (G, H) established for various values of the characteristic parameters of a subterranean formation, to determine values of the parameters of the formation.

12 Claims, 4 Drawing Sheets

PROCESS FOR MEASURING FLOW AND DETERMINING THE PARAMETERS OF MULTILAYER HYDROCARBON PRODUCING FORMATIONS

This is a continuation of application Ser. No. 889,438 filed July 23, 1987, now abandoned.

BACKGROUND OF THE DISCLOSURE

This invention involves a process for measuring the flow as a function of time of the several layers of a subterranean multilayer hydrocarbon-producing formation through which a well is drilled, and of the formation.

Measurements of pressure in oil wells as a function of time in order to determine the characteristics of the productive subterranean formations through which the wells are drilled, have long been known. Although such measurements make it possible to determine a considerable number of parameters characterizing subterranean formations in general, they are insufficient in the case of complex reservoirs such as multilayer formations. A single pressure curve cannot in effect supply the data necessary for the determining the characteristics specific to the various layers, such as their permeability and skin coefficient.

A process for testing multilayer systems was proposed by Gao ("The Crossflow Behavior and the Determination of Reservoir Parameters by Drawdown Tests in Multilayer Reservoirs", SPE paper No. 12580, submitted for publication Sept. 29, 1983). Using the semipermeable wall model published by Deans and Gao in SPE paper No. 11966 presented at the 58th Annual Conference and Exposition at San Francisco, Oct. 5–8, 1983, this process consists of testing each layer individually and recording a series of pressure curves. Such a process involves at least three inconveniences. First, it takes a long time. Second, the interpretation of the curves is tricky if there is any transfer flow between formation layers. Finally, during testing, the well is never in an activity mode similar to a real production situation.

Another method of investigating multilayer systems is to use variations of flow and pressure as a function of depth in a stabilized well, i.e., a well in which production is at a constant surface pressure and flowrate. This type of measurement leads to a "snapshot" of the flow and pressure at each layer for a given surface flowrate and pressure. The data obtained can be presented for various successive surface flowrates in the form of a series of pressure/flow curves for each layer. Here, there are two inconveniences. First, not all wells reach a stabilized flow situation. In addition, it was shown (Lefkovits, H. C., Hzebroek, P., Allen, E. E. and Matthews, C. S.: "A Study of the Behavior of Bounded Reservoirs Composed of Stratified Layers", J. Pet. Tech., March 1961) that the respective flowrates of the layers vary with time. Thus, this process is applicable only to wells which actually reach a steady state.

SUMMARY OF THE INVENTION

Based on the state of the art thus recalled, the purpose of the invention is an original process for determining the characteristic parameters of a multilayer subterranean formation. The process consists essentially of determining the relative variations in time of the flowrates of layers or groups of layers of the formation based on flow measurement points obtained when a total flowrate variation $\Delta Q$ is imposed on a well at a time t1 between a given first constant value and a second given constant value, then comparing these flowrate variations to the behavior of a theoretical model established for various values of the characteristic parameters of a subterranean formation and deducing the values of the parameters of the formation involved from those associated with the behavior of the theoretical model which best coincide with the experimental flow variations.

Such a process makes it possible to determine the characteristic parameters of a subterranean multilayer formation, based mainly on the known fact that variations of the respective flowrates of the layers of the formation are, during an initial period immediately following the well flowrate change, sensitive to wall skin and layer permeability effects and, in a later period, to interlayer fluid transfer effects.

Other characteristics and advantages of the invention will become more clearly apparent from the following description and attached drawings of a non-limitative example.

DESCRIPTION OF THE PREFERRED EMBODIMENTS

Figure 1:
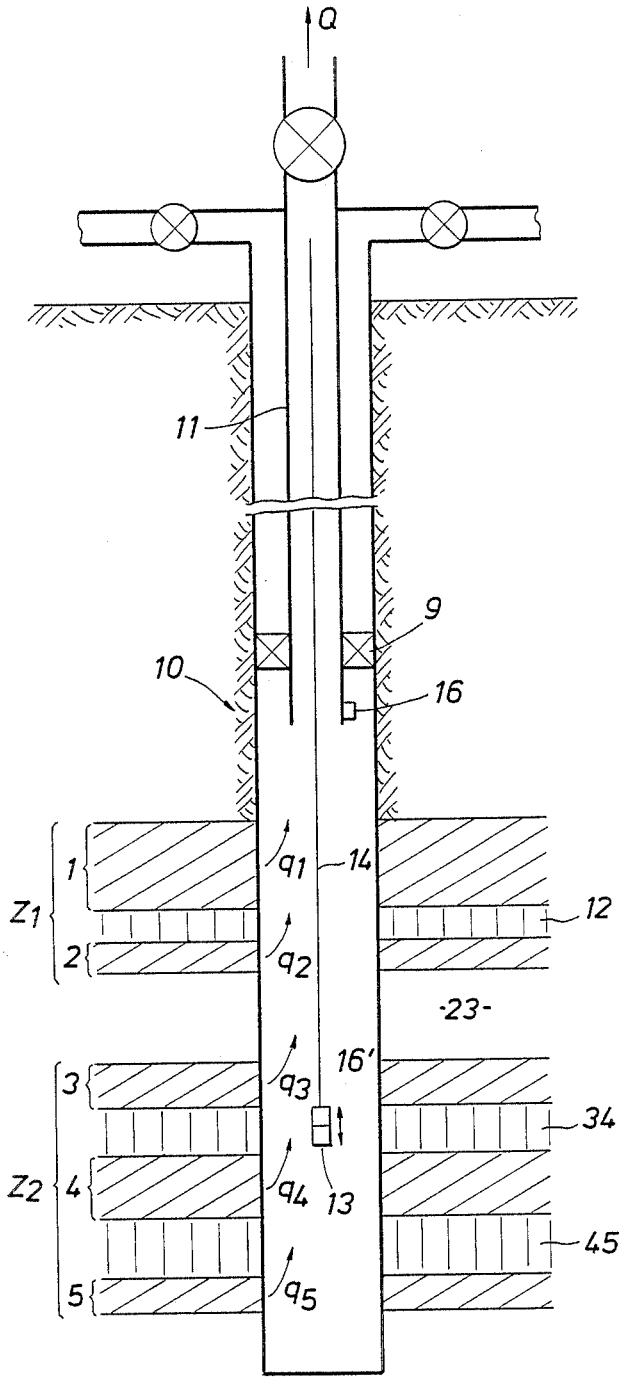
FIG. 1 is a schematic vertical cross-section of an oil well drilled in a multilayer formation into which a flowmeter has been lowered.

FIG. 1 shows an oil well 10 drilled in a formation containing several oil-bearing layers, i.e., five layers, 1, 2, 3, 4 and 5. The intermediate layers 12, 34, 45 separating layers 1 and 2, 3 and 4, and 4 and 5 respectively, have a certain vertical permeability such that there may be oil flow through these intermediate layers. On the other hand, layer 23 between layers 2 and 3 is impermeable and there is not oil flow between these two layers. Each group of layers between which vertical oil flow can occur and which is isolated by impermeable layers is called a "zone". In this example, the formation includes two zones Z1 and Z2, Z1 being composed of layers 1 and 2 and Z2 of layers 3, 4 and 5. By definition, there cannot be any vertical transfer of oil between two zones. This division of the subterranean formation into layers and zones has proven quite advantageous for the interpretation of the results obtained and is one of the characteristics of this invention. The various layers and zones can be identified by making a recording of the flowrate as a function of depth through the formation. Previously made logs of the well can also be used.

When the well is placed in production, it delivers a total oil flow to the surface through its production string 11. The annular space between the casing 10 and the production string 11 is sealed off by the packer 9. The partial flowrates q1 to q5 of layers 1 through 5 make up the total flowrate. The total flowrate Q measured above the formation is the sum of flowrates q1 to q5. It should be noted that the flowrate measured on the surface may differ due to the wellbore storage effect. These flowrates are identical if the effect is zero.

The process according to the invention uses the variations in time of the pressure p in the well and of the partial flowrates q1 to q5 of the various layers resulting from a modification made to the total well flowrate Q.

Figure 2:
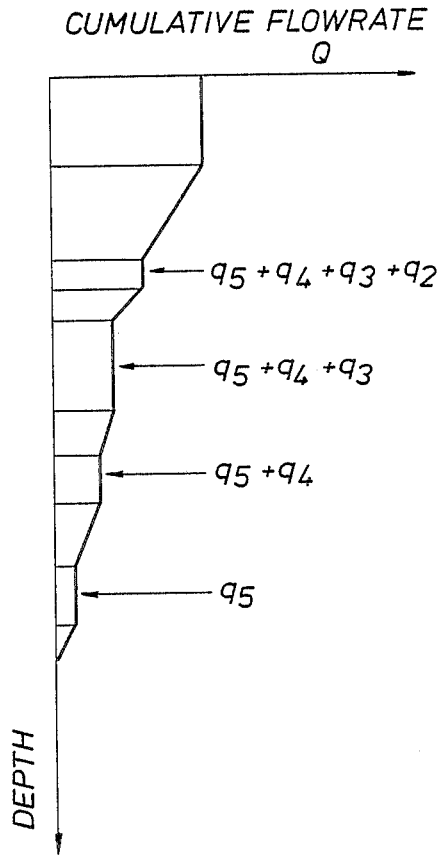
FIG. 2 represents a curve obtained by moving the flowmeter in the well.
Figure 3:
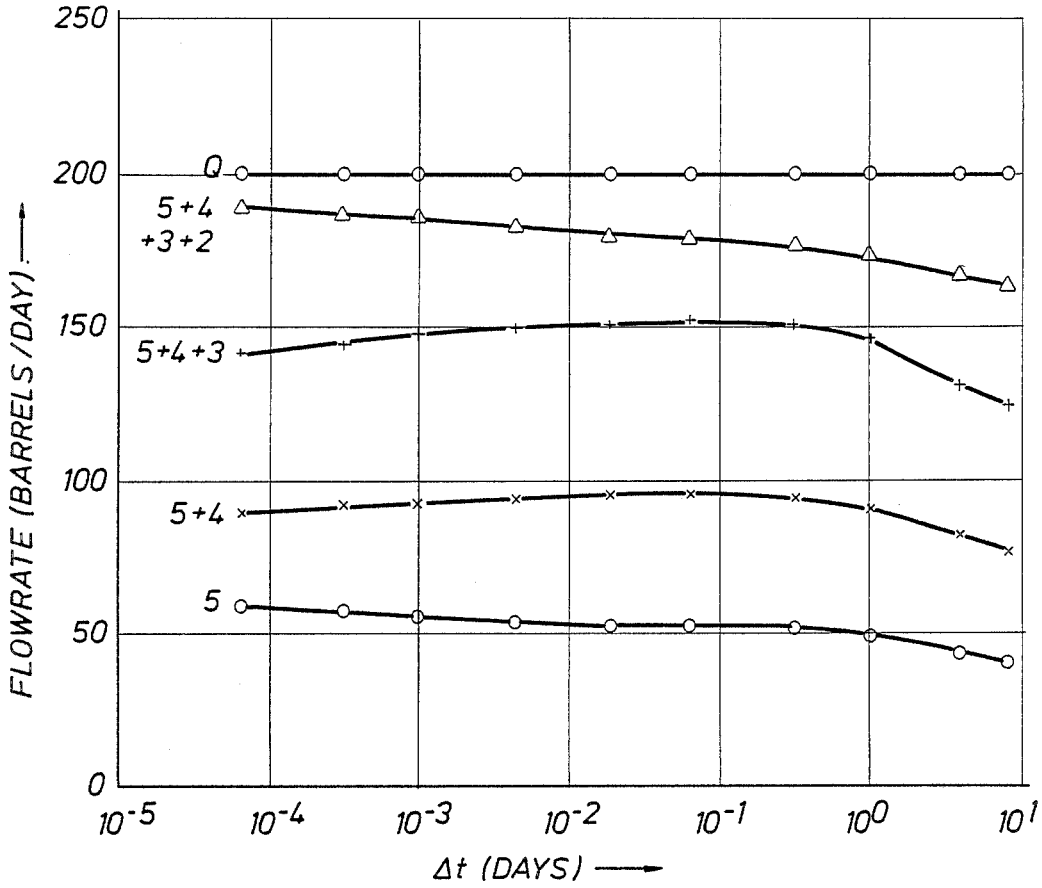
FIGS. 3 and 4 show two sets of flow curves prepared based on curves such as those in FIG. 2.

The flow measurements are made using a flowmeter 13 (for example, as described in French Pat. No. 74/22 391) lowered into the well at the end of a cable 14, then moved vertically several times in a sweeping movement throughout the total depth of the formation. When it is immediately above a layer, the flowmeter measures the cumulative flowrate of that layer and those below it. With each passage, a curve such as the one shown in FIG. 2 is recorded, indicating the flowrate measured as a function of depth, from which the cumulative flowrates of the various layers 1 through 5, i.e., q5, q5+q4, q5+q4+q3, etc., recorded in front of intermediate layers 45, 34, 23, etc., can be deduced. The times at which these flow measurements are made are also recorded. This makes it possible to trace the curves representing the variations in cumulative flow as a function of time. FIG. 3 is a semi-logarithmic representation of such a set of curves, with the flowrates expressed in barrels per day (1 barrel=158.98 liters). Using these curves and simple subtraction, it is possible to trace the set of curves in FIG. 4, which represent the variations of the flowrate specific to each layer 1 through 5 as a function of time.

Figure 4:
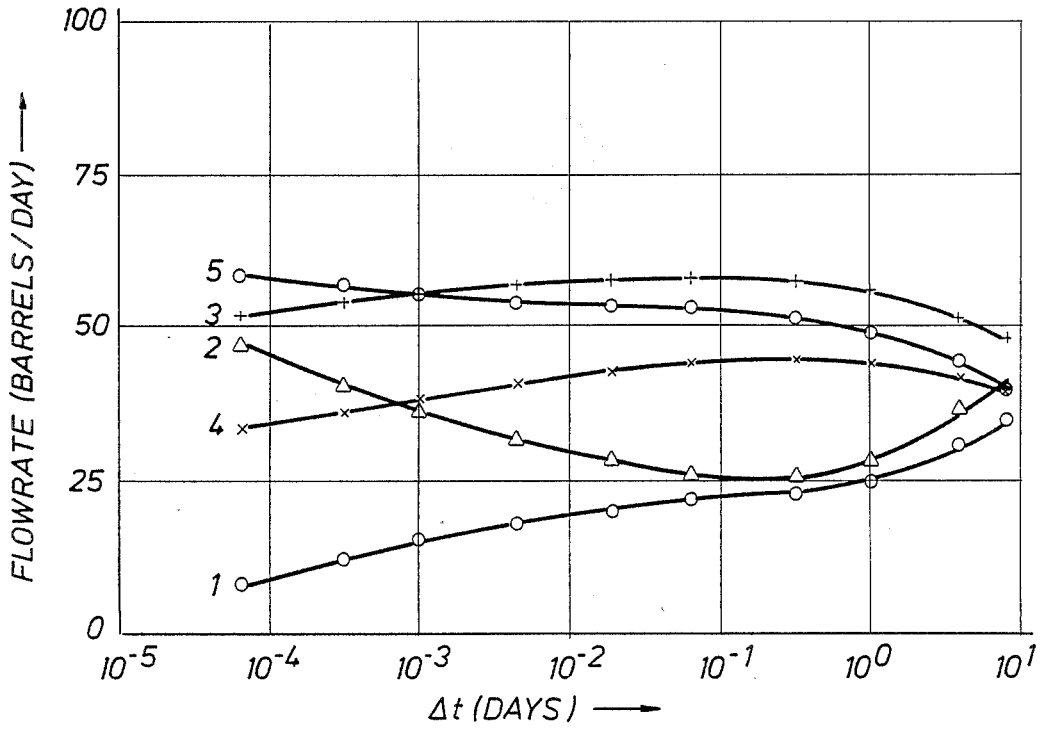

In FIGS. 3 and 4, the measurement times seem to be the same for all the layers. In fact, because of the sweeping movement of the flowmeter 13, these points are offset from one curve to the next. This obviously has no effect on the curve tracing operations.

The cable used may or may not be electrical. If it is, the data from the flowmeter are transmitted through the cable to the surface to be recorded and processed. When the cable used is a simple "piano string", the data are recorded by a downhole recorder with memories. Such a recorder is, as an example, described in British patent application No. 82 31560.

It may be helpful to use several flowmeters connected end-to-end so as to record the respective flowrates of several layers at once or that of a single layer at very short intervals of time.

Pressure measurements are made using a pressure gauge (for example, as described in the French patent published under the No. 2 496 884) which can be installed stationary either at the well-head or (as represented at 16) at the top of the formation or be connected to the flowmeter 13 (at 16'). In the latter case, it must be kept in mind that the pressure gauge is subjected to the pressure of an oil column of variable height. Measurements of the pressure p in the well as a function of time are obtained in this way. Like the flowrate measurements, the pressure measurements are transmitted by electrical cable to the surface to be recorded or are recorded in the well using a recorder.

Figure 5:
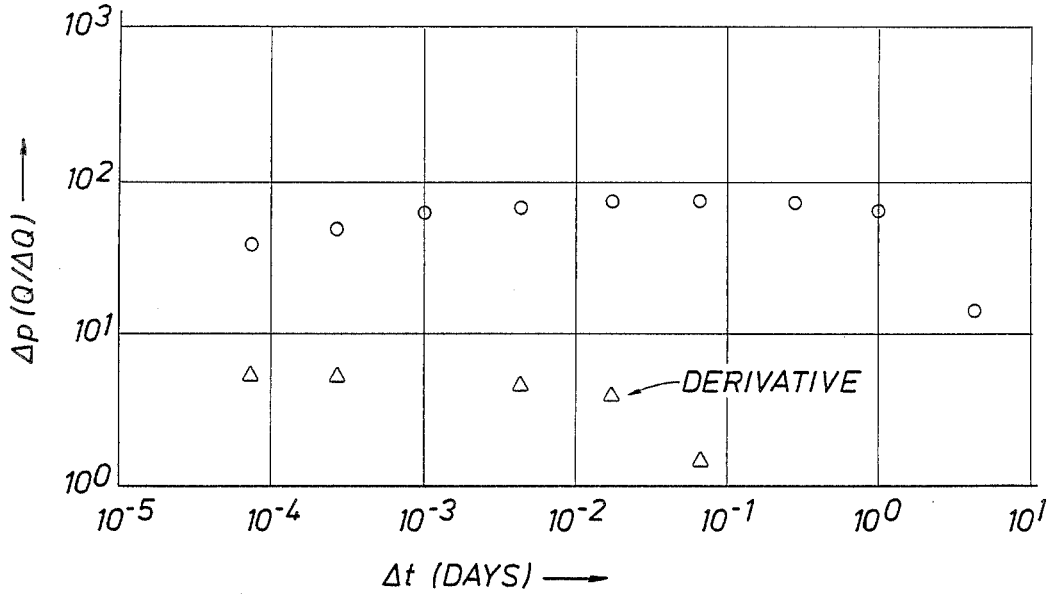
FIG. 5 represents an experimental well pressure/time curve and the derivative curve.

In its measurement phase, the process according to the invention consists essentially of varying the well flowrate Q by a quantity ΔQ at a time t1, and measuring the pressure and the flowrates of the respective layers of the formation just prior to time t1, then for a certain period thereafter. The measurements taken after time t1 make it possible to prepare the sets of flow curves in FIGS. 3 and 4 and the pressure curve in FIG. 5 as a function of the time Δt lapsed after time t1. More precisely, FIG. 5 represents the variations of the quantity $\Delta p \times (Q/\Delta Q)$ with Δp designating the pressure differential measured between times t1 and t1+Δt. The pressure scale is expressed in psi (1 psi=6.9 kPa approx.). The variations of the derivative of the aforesaid quantity Δp are also represented. The abscissa and ordinate scales are logarithmic.

The table at the end of the description gives an example of simulated values of variations of pressure Δp (in psi) as a function of time Δt (Δt being expressed in days and counted from time t1). The values of the variations of the derivative (Δp)' are also indicated, calculated as explained below, as are the flowrate measurements q1 to q5 (expressed in barrels/day and represented on FIG. 4) of the five layers of the formation.

The derivative (Δp)' is calculated as a function of the logarithm of Δt, i.e.:

$$(\Delta p)' = [d(\Delta p)]/[d(\log \Delta t)]$$

The method of calculation and the interpretation of the derivative data are described in the published French patent application No. 83 07075 dated Apr. 22, 1983.

The negative values obtained for Δp and (Δp)' can be explained by the overlay principle which is well known to specialists. Briefly, in order for the measurements to be usable and meaningful, the well flow time prior to the flowrate change must be very long compared to the period of time during which measurements are made after the flowrate change.

In order to plot the curves in FIG. 5, the values of Δp and (Δp)' from the table are multiplied by the ratio Q/ΔQ of the flowrate Q before the change at time t1 to the variation in the flowrate ΔQ before and after time t1. In the example in FIG. 5, Q=500 and ΔQ=500−200=300, as the flowrate after time t1 was reduced from 500 to 200 barrels/day. This is equivalent to normalizing the pressure values after time t1 with the values that would have been obtained before time t1. The normalization of the curves is important as regards the pressure measurements as well as the flowrate measurements because it makes possible the use of the values measured just before time t1 as asympototic values for very long time periods Δt.

This characteristic of the invention, which is important in practice, will be explained in connection with FIG. 7 (points P1 and P2).

For the interpretation of the experimental pressure data, a classical analysis, well known to specialists, is made, consisting of plotting various logarithmic and semilogarithmic graphs to diagnose the wellbore storage effect; the oil flow regime in the reservoir, which can be radial and considered to be infinite at the scale of the well; the presence of several productive layers and the presence of possible reservoir limits. Thus, in logarithmic scales, the wellbore storage effect is shown by a slope equal to 1 for the pressure and pressure derivative curves for short time periods (beginnings of curves) and the presence of a limit or boundary to the reservoir is shown by an increased in the pressure and pressure derivative values for long periods (ends of curves). These diagnostic methods are commonly used in the petroleum industry and are described, for example, in U.S. Pat. No. 4,328,705 and published French patent application No. 83 07075.

The convolution of the total flow measured at the bottom of the well with the pressure can also be used to eliminate the wellbore storage effect from the pressure measurements (in this case, the pressure is called rate convolved pressure). This technique is published in "Interpretation of Pressure Built-up Test using In-situ Measurement of Afterflow", Journal of Petroleum Technology, January 1985.

In its measurement interpretation phase, the process according to the invention includes the following parameter determination operations:

(A) $\overline{kh}$ (average product of formation permeability k × thickness h for the overall formation);

(B) $k_j$ and $s_j$ (horizontal permeability and skin coefficient of layer j, with j varying from 1 to 5 in this example);

(C) type and position of the external limit or boundary of the formation (which determines the extent and type of the formation);

(D) vertical permeability between layers.

A. Determination of the parameter $\overline{kh}$

Based on pressure measurements, using the following formula:

$$\overline{kh} = \frac{141.2\ \Delta Q\ B\mu}{2(\Delta p)'_M}$$

in which:

$\Delta Q$ is the change made in the well flowrate (expressed in barrels/day) at the time $t_1$;

B is the relative volume factor of the oil in the formation and at the surface (equal to the ratio between the volumes of oil in the formation and at the surface);

$\mu$ is the viscosity of the oil expressed in centipoises;

$(\Delta p)'_M$ is the value of the derivative of the pressure p as a function of the logarithm of time in the flat part of the derivative curve (FIG. 5). This flat portion reflects an infinite action radial flow.

In this example, FIG. 5 shows that:

$$(\Delta p)'_M \cdot (Q/\Delta Q) = 5$$

Thus, $(\Delta p)'_M = 3$.

In addition, other measurements revealed that:

$$B = 1.2 \text{ and } \mu = 1.$$

$$\text{Thus, } \overline{kh} = 8.472\ md.\ ft = 25.42 \times 10^2\ \mu m^2.m.$$

B. Determination of $k_j$ and $s_j$

For each layer j, the curve representing as a function of time the fraction of the variation of total flow attributable to the layer involved, i.e., the quantity $\Delta q_j/\Delta Q$, based on the values from the table and the curves in FIG. 4. This results in five series of points in semilogarithmic representation (FIG. 6) for the five layers 1 through 5 of the formation, respectively, as a function of the time $\Delta t$ lapsed after the time t1.

Each series of points is then compared with a theoretical model to determine which of the curves suitably fits the series of points involved, at least during the initial period following the time t1 of the flowrate change. It has been acknowledged that during this period the model used may correspond to the absence of flow between layers in the formation, with an infinite external boundary. After the initial period, deviations may appear between the measurement points and the theoretical curve due to interlayer flow and external boundary effects, or overlay effects.

The theoretical model was established based on the following formula:

$$\overline{q}_{jD} = \frac{k_j \sigma_j K_1(\sigma_j)\, \overline{p}_{wD}}{K_0(\sigma_j) + \delta_j \sigma_j K_1(\sigma_j)} \quad (1)$$

in which:

$\overline{q}_{jD}$ is the Laplace transform of the dimensionless flowrate of layer j;

$$k_j = (kh)_j/\overline{kh} \text{ avec } kh = \sum_{j=1}^{n} (kh)_j\,;$$

$s_j$ is the skin coefficient of layer j;

$K_0$ and $K_1$ are the modified Bessel functions of the first and second types;

$P_{wD}$ is the Laplace transform of the dimensionless pressure in the well;

while $\sigma_j$ is given by:

$$\sigma_j = (\omega_j z/k_j)^{\frac{1}{2}}$$

in which:

$$\omega_j = (\phi h)_j/\overline{\phi h}$$

with:

$$\overline{\phi h} = \sum_{j=1}^{n} (\phi h)_j$$

in which $(\phi h)_j$ designates the product porosity x height of layer j, n the number of layers in the formation and z the Laplace space variable.

Equation (1) does not give flowrate as a function of time. To obtain it, the inverse Laplace transform given by the Stehfest algorithm is applied (see "Numerical inversion of Laplace transforms", D-5, Communications of the ACM, January 1970, No. 1, pages 47 to 49).

When fitting is achieved with a given curve of the theoretical model, the skin coefficient $s_j$ of the layer j involved, appearing in formula (1), can be deduced from it, as can its permeability, which also appears in formula (1) as the product $(kh)_j$ of the permeability and height of said layer, the latter parameter being known by previously made log measurements, while the product $\overline{kh}$ is determined using the pressure measurements explained above.

Figure 6:
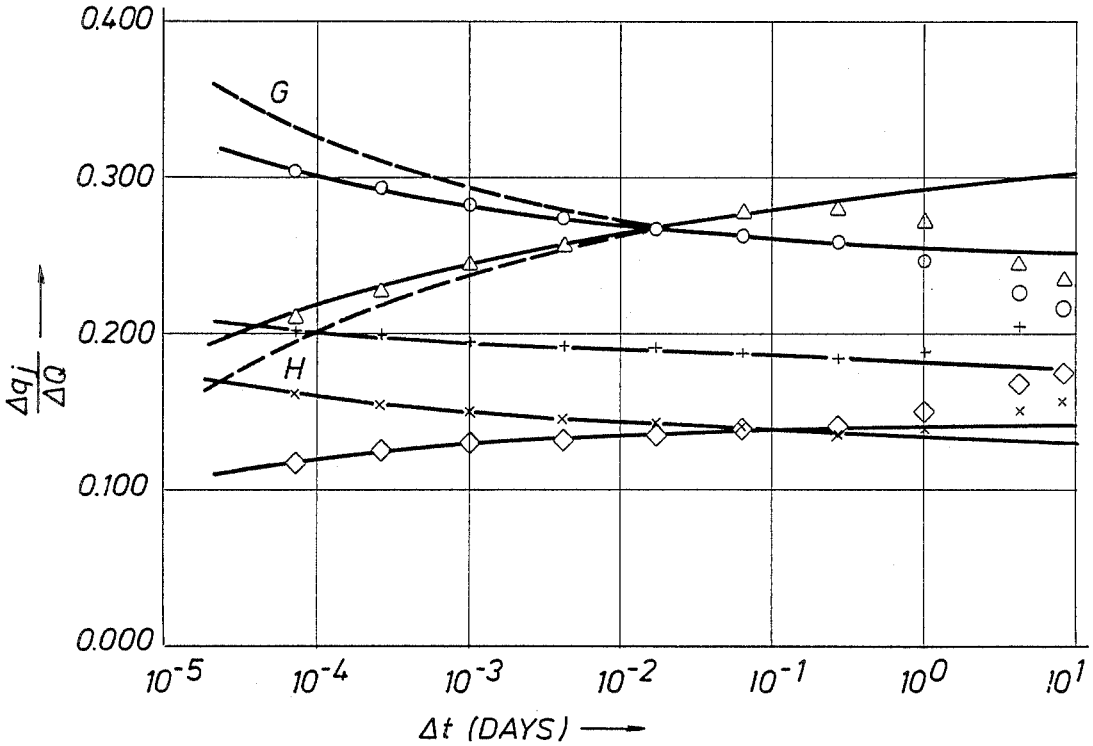
FIGS. 6 through 8 represent flowrate relative variation curves for layers relative to total well flow, distinct groups of layers or zones relative to total well flow and layers relative to the total flowrate of the zone to which the layers belong, respectively.

To illustrate cases which could be encountered in practice, two theoretical curves G and H (dotted lines) are shown in FIG. 6 which do not correctly fit the series of measurement points for formation layers 1 and 2 on the left side of the figure, while there is a good fit on the right side (significant deviations do, however, occur at the extreme right due to boundary and interlayer flow effects). The examination of the position of curve G shows, for example, that the skin coefficient selected for it is too low and should be increased. For curve H, the opposite is true: the skin effect must be reduced, even though a modification of the value of the skin effect of curve G has an influence on the other curves.

These operations make it possible to determine the horizontal permeability $k_j$ and the skin coefficient $s_j$ of each layer of the formation.

Using a different operational mode of this invention, these parameters can be determined as explained below:

It is known to specialists that the result of the mathematical operation of convolution of the derivative of the variations of flow q with dimensionless pressure $P_D$ (the pression that would be obtained if no other parameters intervened in the formation and the well to influence the pressure value and if the flow rate were constant) represents the variations of the pressure $P_{sf}$ effectively measured in the well in front of the formation. This is expressed by the following equation:

$$P_{sf}(T) = \int_0^T q'(T-t) \cdot P_D(t)dt$$

$P_{sf}(T)$ being the value of the pressure variation measured in the well at time T.

To obtain $P_D$, which is the pressure value being sought, requires the mathematical deconvolution between the effectively measured pressure $P_{sf}$ and the flow. However, the results obtained by deconvolution can be sprinkled with significant errors if the experimental data include some noise. Convolution is thus the preferred operation. This is why, within the framework of this invention, the flow variations for each layer and the pressure variations in the well were measured. It was then shown that the convolution of the flow variations for each layer with the pressure variations in the well provides the pressure response of the layer as if it were the only one producing a fluid, provided, however, that there is no interlayer flow. Thus, armed with the pressure response of each layer, it is possible to use the classical methods of interpretation for each, specifically the pressure/time curves plotted on semilogarithmic scales which make it possible to determine the permeability and skin effect.

C. Determination of the external boundary of each zone

The point is to determine the boundary type of each zone:

seemingly infinite boundary;

no-flow boundary, behaving like an impermeable seal, with all the liquid flowing into the well coming from the formation zone located inside this boundary;

Constant pressure boundary.

In the first instance, it is as though there were no boundary. In the other two cases, the radius of the boundary must also be specified.

For this determination, a graph (FIG. 7) similar to FIG. 6 is prepared, in which each series of points corresponds to a zone i of the formation based on the above definition, and no longer to a given layer (of course, a zone may contain only one layer).

In this example, there are two zones Z1 and Z2 (FIG. 1) and the two series of points represent, respectively, the following quantities:

$$\frac{\Delta q1 + \Delta q2}{\Delta Q} \text{ and } \frac{\Delta q3 + \Delta q4 + \Delta q5}{\Delta Q}$$

as a function of the time $\Delta t$. The values from the table are used to plot the experimental curves in FIG. 7.

In addition, theoretical models corresponding to the above formula (1), as well as the following formulas, were used:

$$\overline{q}_{jD} = \frac{k_j\sigma_j\psi_{1j}\overline{p}_{\omega D}}{\psi_{01j} + \delta_j\sigma_j\psi_{1j}} \quad (2)$$

and $$\overline{q}_{jD} = \frac{k_j\sigma_j\psi_{10j}\overline{p}_{\omega D}}{\psi_{0j} + \delta_j\sigma_j\psi_{10j}}. \quad (3)$$

In these formulas, formula (2) being already known, the quantities are defined as follows:

$$\psi_{0k}(Z) = K_0(\sigma_k)I_0(\gamma_{eD}\sigma_k) - I_0(\sigma_k)K_0(\gamma_{eD}\sigma_1)$$

$$\psi_{1k}(Z) = K_1(\sigma_k)I_1(\gamma_{eD}\sigma_k) - I_1(\sigma_k)K_1(\gamma_{eD}\sigma_1)$$

$$\psi_{01k}(Z) = K_0(\sigma_k)I_1(\gamma_{eD}\sigma_k) + I_5(\sigma_k)K_1(\gamma_{eD}\sigma_k)$$

$$\psi_{10k}(Z) = K_1(\sigma_k)I_0(\gamma_{eD}\sigma_k) + I_1(\sigma_k)K_0(\gamma_{eD}\sigma_k)$$

in which $I_0$, $I_1$, $K_0$ and $K_1$ are modified Bessel functions of the first and second type and $r_{eD}$ is the dimensionless external radius of the formation.

Formula (1) refers to the case of a boundary behaving as if it were infinite, formula (2) a no-flow boundary and formula (3) a constant pressure boundary.

Figure 7:
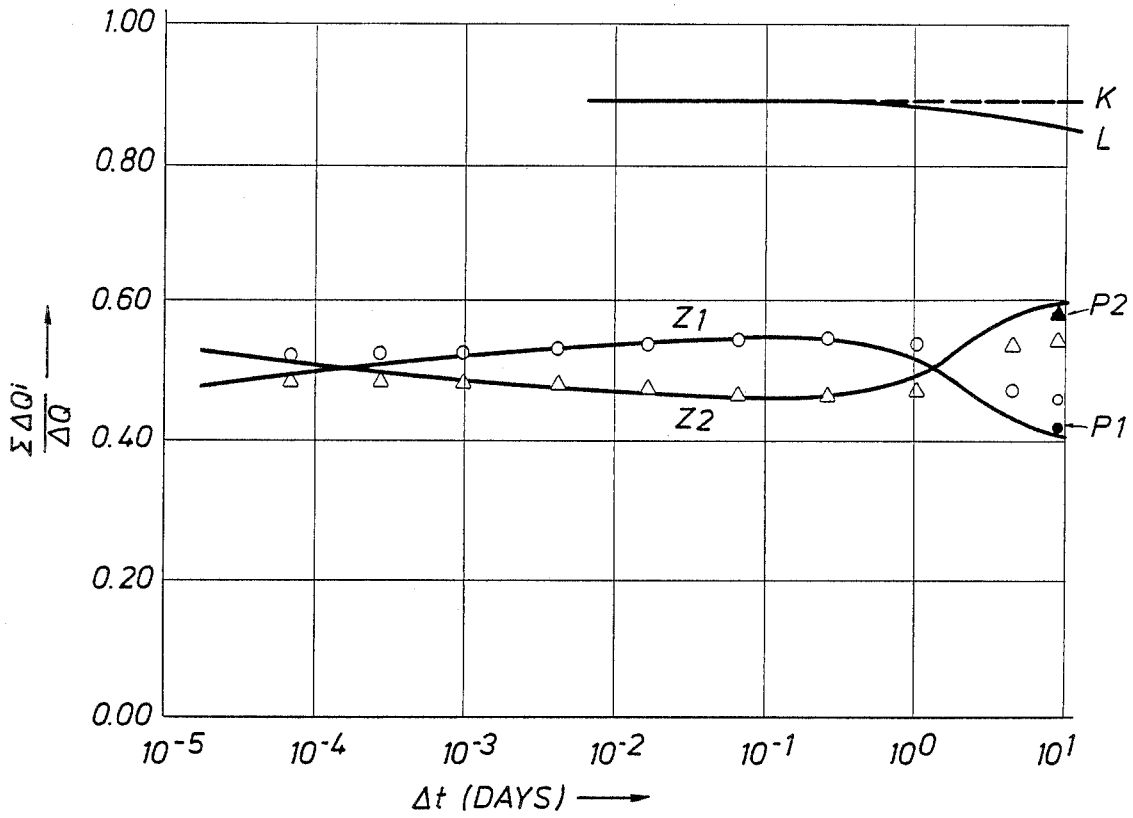

FIG. 7 shows the fitting achieved (in the initial period) between the series of points corresponding to zones Z1 and Z2 and the curves defined based on formula (2). It can be concluded that the boundary of the zones under study is of the "no-flow" type.

If the fitting is achieved with a curve ending with a horizontal, such as curve K corresponding to formula (3), sketched at the top right of FIG. 7, the boundary is of the "constant pressure" type. If the curve ends with a slight downward bend, like curve L resulting from formula (1), the boundary is of the apparently infinite type.

Indeed, in these operations relative to the various zones of the formation, there is no need to envision a vertical transfer flow situation, since such transfers are by definition inexistent between zones.

In the case represented in FIG. 7, showing a no-flow boundary, i.e., a situation in which the production volume of the formation is limited, the straight portion of the curve for each zone tends towards a value equal to the product $\phi h$ for the zone, i.e., in this example, 0.4 for zone Z1 and 0.6 for zone Z2. These values are in addition known due to previous logging operations.

FIG. 7 also shows that the straight portion of the curves deviates from the experimental points. This is because of an overlay effect due to the fact that the well in question was placed in production for 200 hours (8.33 days) and then its production flow rate was reduced (from 500 to 200 barrels/day) at time t1, for another 200 hours. However, if a measurement is made at the end of the first 200-hour period, just prior to time t1, the results obtained can be recorded on the figure (points P1 and P2) and considered as measurement points obtained after the initial period, after time t1, without overlay effect. As can be seen, the theoretical curves are very close to these points.

It results from the foregoing remark that, in practice, there is no need to make measurements at times distant from time t1, since measurements made just prior to that time can advantageously replace them. Thus, the measurements at the points located approximately between $10^0$ and $10^1$ days after t1 need not be made, and this considerably shortens the total time required for well measurements.

As a result, it is possible to determine using only the measurements taken just before t1 whether the boundary is of the no-flow type (if the measurement points correspond to the known values of $\phi h$) or not (if the measurement points do not correspond), since this effect depends solely on boundary conditions.

If the boundary is recognized to be non-infinite, its radius is determined by finding the radius value which leads to the best fit between the model curves and the measurement curves in the period following the initial period. The measurement points recorded just prior to the change in the well's flow rate are also very useful in this phase of determination of formation parameters.

As in the case of the determination of permeability and skin effect, there is a second possible method using convolution operations. It has, in fact, been shown that the convolution of the flow variations of each zone with the pressure variations in the well provides the pressure response of the zone involved. As in the case of the individual layers, this harks back to a classical well test interpretation, particularly for the determination of the boudary of each zone.

D. Determination of interlayer permeability

Having determined the horizontal permeability and the skin coefficient of each layer of the formation, the type and location of the zone boundaries, the vertical permeability between layers remains to be determined. This is done by means of an analysis in each zone of the formation of the flow rates of the layers of the zone as compared to the zone's total flow rate.

Figure 8:
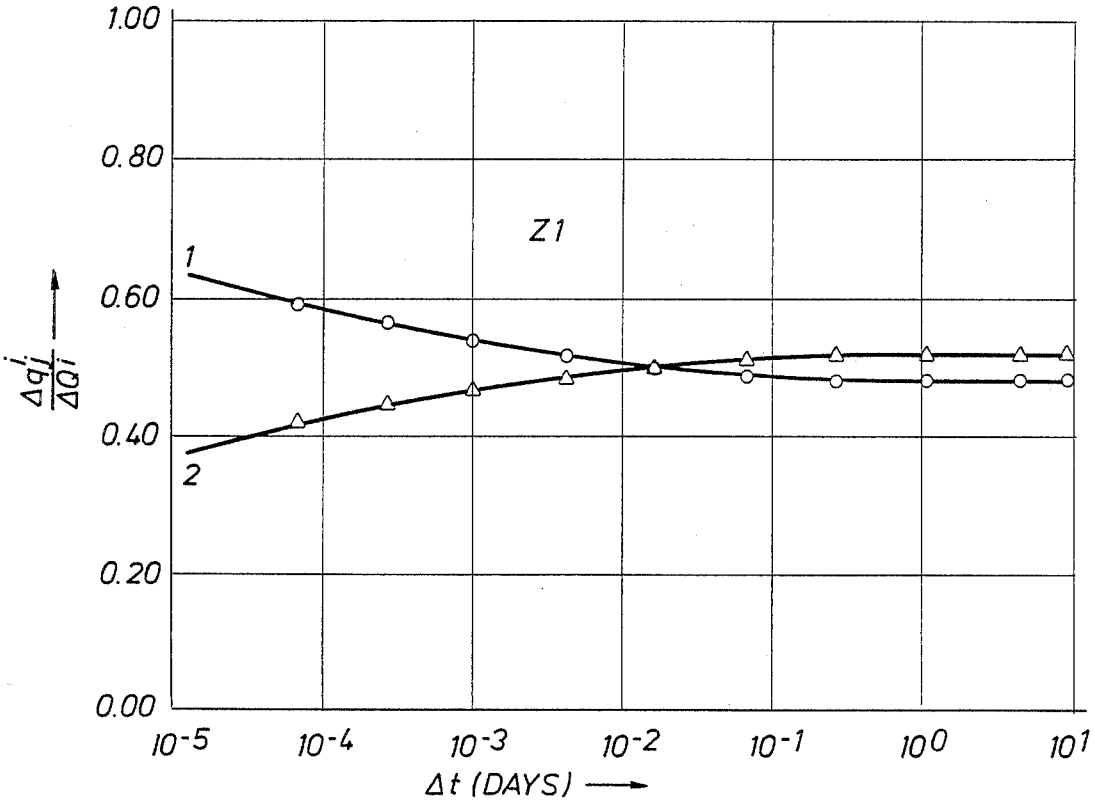

As is shown in FIG. 8, we show as a function of $\Delta t$, still using a semilogarithmic representation and based on the table data, the quantities $\Delta q_j^i/\Delta Q^i$ in which $\Delta Q^i$ designates the flow rate variation of zone i and $\Delta qij$ the flow rate variation of layer j belonging to zone i. FIG. 8, as an example, is limited to the measurements for zone Z1, composed of layers 1 and 2, the values for which are indicated in the table (page 19).

The theoretical model used, established for the case in which there are transfer flows between layers, is derived from the following formula:

$$\begin{aligned}\bar{q}_{jD} &= (1 - C_D p_{\omega Dz2}) q_{jDCD=0} \\ &= (1 - C_D p_{\omega Dz2})\, k_j \sum_{k_i=1}^{m_i} A_1^{ki}\, a_j^{ki}\, \sigma_{ki} \\ &\quad [K_i(\sigma_{ki}) - b^{ki} I_1(\sigma_{ki})]\end{aligned}$$

in which:

$\bar{q}_{jD}$ is the dimensionless flow rate of layer j of zone i, which contains $m_i$ layers;

$C_D$ is the dimensionless wellbore storage constant;

$K_j$=ratio of the product permeability x height for layer j to the average product $\overline{kh}$ permeability-×height for zone i;

$\sigma_{ki}$ represents the quantity $\sigma_k$ for zone i;

$\sigma_k$ are the roots of the equation $\gamma_n=0$ in which $\gamma_j$ is a polynomial defined by recurrence by:

$$\gamma_j=\gamma_{j-1}\alpha_{jj}-\gamma_{j-2}\alpha_{j,j-1}\alpha_{j-1,j}$$

for $j=2, \ldots, n$ with $\gamma_0=1$ and $\gamma_1=a_{11}$, $a_{jk}$ designating the elements of the matrix $[a_{jk}]$:

$$\alpha_{jk} = \begin{cases} \lambda_{j-1}, & \text{for } k = j-1; j > 1, \\ k_j\sigma^2 - \omega_j z - \lambda_{j-1} - \lambda_j, & \text{for } k = j, \\ \lambda_j, & \text{for } k = j+1; j < n, \\ 0, & \text{for } k \neq j-1, j, \text{ or } j+1, \end{cases}$$

$\alpha_j^{ki}$ is a coefficient relative to layer j, root k, for zone i, defined by the formula:

$$\bar{P}_{jD} = \sum_{k_i=1}^{m_i} [A_1^{ki}\alpha_j^{ki}K_0(\sigma_{ki}\tau_D) + B_1^{ki}\alpha_j^{ki}I_0(\sigma_{ki}\tau_D)]$$

$b^{ki}$ is an external boundary condition coefficient defined by the formulas:

$b^{ki}=0$ for an apparently infinite boundary $b^{ki}= =K_1(\sigma_{ki}\gamma_{eD})/I_1(\sigma_{ki}\gamma_{eD})$ for a no-flow boundary $b^{ki}=-K_0(\sigma_{ki}\gamma_{eD})/I_0(\sigma_{ki}\gamma_{eD})$ for a constant pressure boundary, while $B_1^{ki}$ is related to $A_1^{ki}$ by the equation:

$$B_1^{ki}=b^{ki}A_1^{ki}$$

$A_1^{ki}$ being determined based on well conditions.

The skin effect coefficient values obtained in interpretation phase (B) are used, keeping in mind the type and location of the formation's external boundary as determined in phase (C). Finally, a set of values is sought for the parameters $\lambda_j$ of interlayer permeability between layers j and j+1 of each zone i such as to achieve good fit of the curves for all the $\Delta q_j/\Delta Q^i$ ratios considered.

More precisely, it can be noted that the appearance of the curves in the left-hand portion of the figure depens on permeability and skin effect, while the right-hand side of FIG. 8 depens also on the type of boundary and transfer flows. Since the permeability, skin effect and boundary type are known, the only remaining parameter is transfer flow, for which different values are tried until a good curve fit is achieved.

These operations are repeated for each of the zones of the formation, so as to determine the transfer flow parameters for all layers.

The set of calculations and curve fitting operations just described as part of the process according to the invention can be done by hand or, preferably, by a digital calculator. In the first instance, sets of typical curves are traced using the equations given above. These sets of curves are a graphic representation of the behavior of the theoretical models. A digital calculator can also be used to select the values of the parameters being sought which correspond to a perfect fit between the theoretical and experimental variations of the various functions of the pressure and flow rates (variation of pressure, of the derivative of pressure, of the fraction of the variation of the total flow rate for a given layer and for a given zone and of the fraction of the variation of flow rate of a layer as compared to the flow rate of the zone to which it belongs, all as a function of time).

TABLE

| Δt | Δp | (Δp)' | q1 | q2 | q3 | q4 | q5 |
|---|---|---|---|---|---|---|---|
| 6,67 E - 5 | 23,93 | 3,03 | 9,33 | 46,37 | 52,42 | 34,07 | 57,82 |
| 2,67 E - 4 | 28,13 | 3,02 | 12,90 | 40,77 | 53,68 | 36,66 | 56,00 |
| 1,02 E - 3 | 32,16 | 2,91 | 15,73 | 36,20 | 54,78 | 38,63 | 54,66 |

TABLE-continued

| Δt | Δp | (Δp)' | $q_1$ | $q_2$ | $q_3$ | $q_4$ | $q_5$ |
|---|---|---|---|---|---|---|---|
| 4,06 E - 3 | 36,05 | 2,68 | 18,03 | 32,37 | 55,74 | 40,19 | 53,67 |
| 1,63 E - 2 | 39,62 | 2,23 | 19,98 | 29,03 | 56,56 | 41,51 | 52,93 |
| 6,65 E - 2 | 42,28 | 0,99 | 21,59 | 26,19 | 57,15 | 42,68 | 52,38 |
| 0,26 | 42,41 | −2,16 | 22,75 | 25,14 | 57,44 | 43,27 | 51,40 |
| 1,05 | 36,24 | −12,29 | 25,63 | 27,94 | 56,32 | 41,91 | 48,20 |
| 4,19 | 8,34 | −42,72 | 32,48 | 35,42 | 51,41 | 38,00 | 42,69 |
| 8,33 | −29,69 | −55,40 | 35,76 | 39,00 | 48,83 | 36,06 | 40,35 |

In the table, the notation "E-5" signifies "Exponential-5".

I claim:

1. A method for determining a physical characteristic of a system made up of underground formations traversed by a fluid producing wellbore, comprising the steps of:

flowing the wellbore at a first constant rate;

obtaining first measurements characteristic of the pressure and flow rate of the fluid at successive depths of the wellbore;

flowing the wellbore at a second constant rate which is different from said first constant rate;

obtaining second measurements characteristic of the pressure and flow rate of the fluid at successive depths of the wellbore;

obtaining third measurements characteristic of the pressure and flow rate of the fluid at successive depths of the wellbore during the transitory period when the wellbore flow rate is changed from said first flow rate to said second flow rate; and deriving from said first, second and third measurements a characteristic of fluid production from at least one of said underground formations.

2. The method of claim 1 wherein said second constant rate is approximately one half the flow rate of said first constant rate.

3. The method of claim 1 further comprising the step of recording said first and second measurements as a function of time.

4. Process for determining characteristic parameters of a multi-layer subterranean hydrocarbon-producing formation through which a well is drilled, comprising the steps of:

producing a flow through the well;

determining the relative variations in time of the flow rates of a layer or group of layers of the formation with respect to flow rate measurement points obtained when a total flow rate variation ΔQ has been imposed on the well at a time $t_1$ between a first given constant flow value and a second given constant flow value, comparing those flow rate variations with the behavior of a theoretical model established for various values of the characteristic parameters of a subterranean formation, and deducing the values of the parameters of a layer or group of layers involved from those associated with the behavior of the theoretical mode which best fit the experimental flow rate variations.

5. Process according to claim 4 further comprising the step of measuring pressure values at the same time as said flow rates of said layers and calculating the product kh representing the product of permeability and formation thickness.

6. Process according to claim 5, further comprising the steps of: convoluting the variations of flow rate of each layer j with the well pressure variations.

7. Process according to claim 4, further comprising the steps of: for each layer j of the formation the variations of the fraction $\Delta q_j/\Delta Q$ representing the ratio of flow rate variations $\Delta q_j$ of layer j to the variation ΔQ of the total well flow rate Q are determined as a function of time Δt, and the horizontal permeability and skin coefficient parameters $k_j$ and $s_j$ of the layer are deduced by comparing said variations $\Delta q/\Delta Q$ with the behavior of a theoretical model.

8. Process according to claim 4, further comprising the step of: for each zone i of the formation, representative of a group of productive layers contained between two impermeable intermediate layers, a determination is made of the variations as a function of time, of the fraction $\Sigma\Delta q^i/\Delta Q$ representing the ratio of the flow rate variations of said zone i to the variation in the total flow rate Q of the well, and the type and position of the external boundary of said zone are deduced from the comparison between said variations of said fraction and the behavior of the theoretical model.

9. Process according to claim 8 further comprising the step of: convoluting the flow rate variations of each zone i with the well pressure variations to obtain the pressure response of the zone involved.

10. Process according to claim 9 further comprising the step of obtaining flow rate measurements just prior to time t1.

11. Process according to claim 8 further comprising the step of: for each layer j of a zone i of the formation, a determination is made of the variations of the fraction $\Delta q_j/\Delta Q^i$ representing the ratio of the flow rate variations of layer j to the flow rate variation of zone i, and the interlayer permeability parameters of the zone involved are deduced by a comparison between the said variations of the said fraction and the behavior of the theoretical model, for each of the layers in the formation.

12. Process according to claim 11 further comprising the step of: plotting the curves representing the variations of said fractions and then fitting the same to the curves representing the theoretical model of the characteristics of the subterranean formation.

* * * * *